US006966632B2

(12) United States Patent
Huang et al.

(10) Patent No.: US 6,966,632 B2
(45) Date of Patent: Nov. 22, 2005

(54) MICROINJECTOR WITH GROUNDING CONDUCTION CHANNEL

(75) Inventors: Tsung-Wei Huang, Taipei (TW); Chung-Cheng Chou, Tao-Yuan Hsien (TW)

(73) Assignee: BenQ Corporation, Tao-Yuan Hsien (TW)

( * ) Notice: Subject to any disclaimer, the term of this patent is extended or adjusted under 35 U.S.C. 154(b) by 46 days.

(21) Appl. No.: 10/605,656

(22) Filed: Oct. 16, 2003

(65) Prior Publication Data

US 2005/0083375 A1 Apr. 21, 2005

(51) Int. Cl.[7] ..... B41J 2/14; B41J 2/16
(52) U.S. Cl. ..... 347/50; 347/48; 347/59
(58) Field of Search ..... 347/63, 64, 48, 347/50, 56–59, 65, 67

(56) References Cited

U.S. PATENT DOCUMENTS 6,471,338 B2 10/2002 Chen ..... 347/59
6,814,428 B2 * 11/2004 Huang et al. ..... 347/50

* cited by examiner

*Primary Examiner*—Juanita D. Stephens
(74) *Attorney, Agent, or Firm*—Winston Hsu

(57) ABSTRACT

A microinjector comprises a chamber for containing fluid, an orifice in fluid communication with the chamber, the orifice being disposed above the chamber, an actuator disposed proximately adjacent the orifice and external to the chamber for ejecting fluid from the chamber, a metal layer disposed above the chamber, and a conduction channel connected between the metal layer and ground, for preventing parasitic capacitance.

21 Claims, 7 Drawing Sheets

MICROINJECTOR WITH GROUNDING CONDUCTION CHANNEL

BACKGROUND OF INVENTION

1. Field of the Invention

The present invention relates to an inkjet printhead, and more particularly, to a microinjector of the ink jet printhead.

2. Description of the Prior Art

In recent years, a microinjector for ejecting fluids, such as gas, ink, chemical solutions and other liquid materials, has been widely applied to fluid-ejecting apparatuses like an inkjet printhead in an inkjet printer. As microinjectors become cheaper and more reliable, and as high quality fluids of high frequency and spatial resolution come to the market, the microinjector is becoming more and more popular and has a wide number of uses. For example, a microinjector can be applied to a variety of industrial fields, such as a fuel injection system, a cell sorting system, a drug delivery system, a micro jet propulsion system, and print lithography.

Please refer to FIG. 1, which is a schematic diagram of a microinjector 10 according to the prior art. The microinjector 10 is disclosed in a U.S. Pat. No. 6,102,530, "Apparatus and method for using bubbles as virtual value in microinjector to eject fluid". The microinjector 10 comprises a chamber 12, a manifold 14 connected to the chamber 12, an orifice 16 disposed above the chamber 12, a first heater 18, a second heater 20, and a $SiO_2$ layer (not shown). The first and second heaters 18 and 20 are both disposed proximately adjacent to the orifice 16 and external to the chamber 12. The first and second heaters 18 and 20 are typically electrodes connected in series to a common electrode (not shown). The chamber 12 and the manifold 14 of the microinjector 10 are filled with fluid (not shown).

The first heater 18 has a cross sectional area smaller than that of the second heater 20, and the first heater 18 accordingly has a heat efficiency higher than that of the second heater 20. Therefore, driven by the same common electrode, the first heater 18 generates a first bubble 22 earlier than the second heater 20 generates a second bubble 24. It can be seen that the first bubble 22 has a volume bigger than that of the second bubble 24.

The first heater 18 generates the first bubble 22 that is big enough to form a virtual valve to prevent the fluid contained in the manifold 14 from entering the chamber 12 in order to diminish a cross talk effect between the chamber 12 and other chambers neighboring the chamber 12 to impact the chamber 12 of the microinjector 10. At the same time, the second bubble 24, with a growing volume driven by the second heater 20, ejects the fluid confined in the chamber 12 through the orifice 16 to a region outside of the chamber 12 gradually.

Please refer to FIG. 2, which is another schematic diagram of the microinjector 10 according to the prior art. As the second bubble 24 grows and has a volume large enough to contact with the first bubble 22, the first bubble 22 combined with the second bubble 24 are capable of preventing fluid confined in a region 26 opposite to the orifice 16 from being ejected to a region outside of the chamber 12, omitting the satellite droplets.

After the fluid has been ejected to a region outside of the chamber 12 by the combination of the first and second bubbles 22 and 24, the common electrode stops driving the first and second heaters 18 and 20. Therefore, the volumes of the first and the second bubbles 22 and 24 decrease gradually and the chamber 12 is filled with fluid again.

Please refer to FIG. 3, which is a schematic diagram of a silicon wafer 30 ready to be etched into the microinjector 10 according to the prior art. The silicon wafer 30 comprises a phosphosilicate-glass (PSG) 32 as a sacrificial layer and a low stress silicon nitride 34 as a top surface of the chamber 12. In a bulk etching process for the silicon wafer 30, the silicon wafer 30 is etched in a solution of potassium hydroxide (KOH), while the sacrificial layer 32 of the silicon wafer 30 is removed by hydroflouric acid (HF). Experiments show that the chambers 12 top surface 34, which is formed by the low stress silicon nitride, is fragile and easily cracked. The KOH solution probably etches a surface of the silicon wafer 30 and therefore reduces a yield rate of the silicon wafer 30 or even damages the silicon wafer 30.

The experiments also show that the silicon nitride 34, further coated with a layer of metal, such as gold and nickel, not only has a more rigid structure, the silicon nitride 34 also has an additional radiation function, for smoothing the fabrication of the manifold 14 and the orifice 16.

In the microinjector 10, the $SiO_2$ layer has a dielectric constant of approximately 3.9–4.5, and a thickness of 0.5 $\mu$m, while the silicon nitride 34 has a dielectric constant of approximately 6–8, and a thickness of 0.5 $\mu$m. The metal layer, which is coated on the silicon nitride 34, has a large area and a corresponding large parasitic capacitance. Such a large parasitic capacitance results in the metal layer accumulating a great deal of charge. This charge easily couples to circuits disposed on a region under the silicon nitride 34, deforming a square wave driving the microinjector 10 to have a shark-fin-shaped overshoot waveform, as shown in FIG. 4. The square wave with the overshoot probably damages the first and second heaters 18 and 20 sequentially or a MOS transistor in the microinjector 10. Moreover, too large of a parasitic capacitance also accompanies an increasing RC, thereby reducing driving frequency as well as printing efficiency, creating a problem of signal delay.

SUMMARY OF INVENTION

It is therefore a primary objective of the claimed invention to provide a microinjector comprising not only a metal plate but also a conduction channel to connect the metal plate to ground.

According to the claimed invention, the microinjector comprises a chamber for containing fluid, an orifice in fluid communication with the chamber, the orifice being disposed above the chamber, an actuator disposed proximately adjacent the orifice and external to the chamber for ejecting fluid from the chamber, a metal layer disposed above the chamber, and a conduction channel connected between the metal layer and ground.

It is an advantage of the claimed invention that the microinjector includes not only the metal plate but also the conduction channel to connect the metal plate to ground, for overcoming the problem of parasitic capacitance. Moreover, such a large metal plate, combining with the silicon substrate, provides shielding effect and good heat radiation performance.

These and other objectives of the claimed invention will no doubt become obvious to those of ordinary skill in the art after reading the following detailed description of the preferred embodiment that is illustrated in the various figures and drawings.

DETAILED DESCRIPTION

Figure 5:
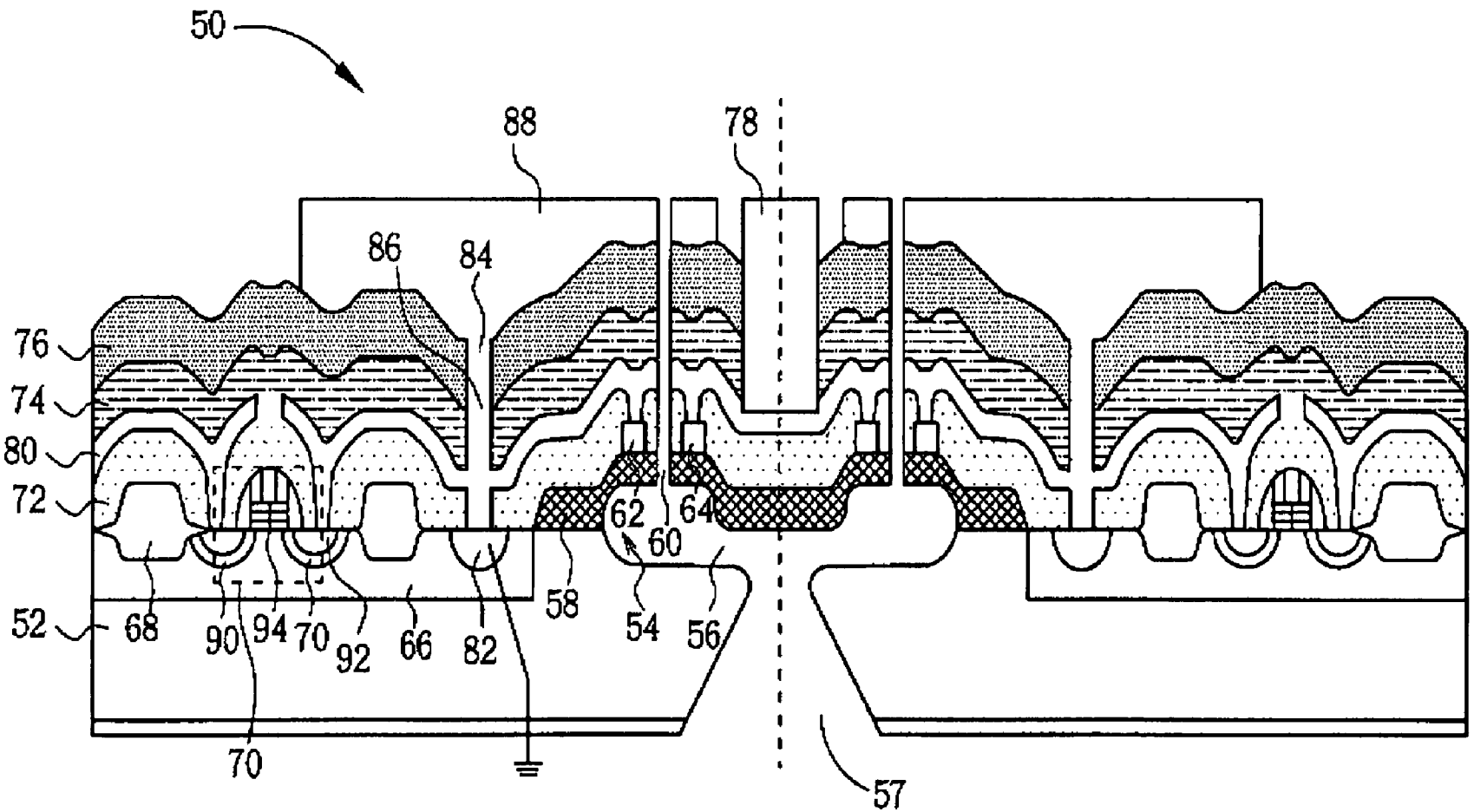
FIG. 5 is a cross sectional diagram of a microinjector according to the present invention.

Please refer to FIG. 5, which is a cross sectional diagram of a microinjector 50 according to the present invention. The microinjector 50 comprises a silicon substrate 52 connected to ground, a chamber 54 formed on the silicon substrate 52 for containing fluid, a manifold 56 formed between a fluid tank 57 and the chamber 54 for passing fluid from the fluid tank 57 to the chamber 54, a low stress silicon nitride 58 installed on a top surface of the chamber 54, and an orifice 60 in fluid communication with the chamber 54, the orifice 60 being disposed above the chamber 54. The microinjector 50 also includes a first heater 62 and a second heater 64, both of which are disposed proximately adjacent to the orifice 60 and external to the chamber 54 for ejecting fluid from the chamber 54, a P-well doped region 66, a field oxide 68, a MOSFET 70 as a driving circuit formed on the P-well doped region 66 for controlling the first and second heaters 62 and 64, and a first and a second $SiO_2$ layer 72 and 74, both of which are formed covering the first and second heaters 62 and 64. The microinjector contains a $Si_xN_y$ layer 76 formed covering the second $SiO_2$ layer 74, a metal pad 78, a metal layer 80 formed between the first and second $SiO_2$ layers 72 and 74, a first metal connector formed in the metal layer 80 for connecting the first and second heaters 62 and 64 and the metal pad 78, a $P^+$ ion implant 82 as a guard ring formed adjacent to the MOSFET 70 for receiving holes emitted from the MOSFET 70, which is functioning under an electric field of high electricity, a metal plate 88 formed covering the $Si_xN_y$ layer 76, a passivation opening 84 formed on a region that the metal plate 88 overlaps the $P^+$ ion implant 82, and a conduction channel 86 connecting the passivation opening 84 to the $P^+$ ion implant 82.

Figure 6:
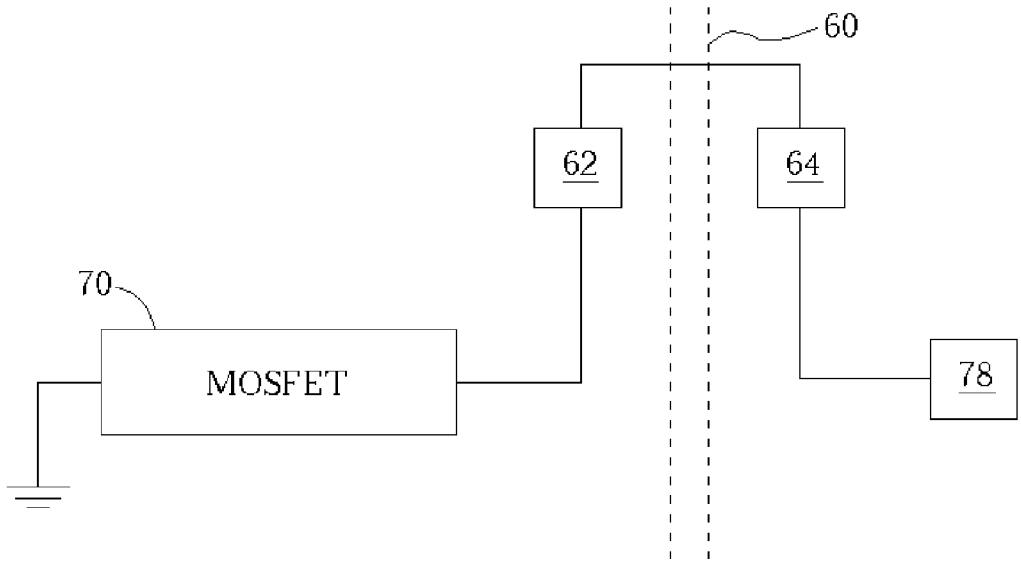
FIG. 6 is an equivalent circuit diagram of an actuator of the microinjector shown in FIG. 5 according to the present invention.

Please refer to FIG. 6, which is an equivalent circuit diagram of an actuator of the microinjector 50 according to the present invention, the actuator comprising the first and second heaters 62 and 64. The first metal connector connects the metal pad 78, the second heater 64, the first heater 62, the MOSFET 70, and ground sequentially.

The MOSFET 70 comprises a lightly doped drain (or double diffused drain) 90 connected to a program line (not shown), a source implant 92, and a poly-silicon gate 94 connected to an address line (not shown). The microinjector 50 can utilize a bipolar transistor, a JEFT transistor, or a P-N diode to substitute for the MOSFET 70. The metal layer 80 is made of a metal selected from a group consisting of aluminum, gold, copper, tungsten, and alloys of Al—Si—Cu. The microinjector 50 further comprises a second metal connector formed in the metal layer 80 for connecting the metal plate 88 and the $P^+$ ion implant 82 to ground. The driving circuit 70 can also comprise bipolar transistors, JFET transistors, or diodes alternatively.

The $P^+$ ion implant 82 of the microinjector 50 receives holes emitted from the MOSFET 70 and transmits the holes to ground via the second metal connector to isolate the MOSFET 70 from noise. In a process to fabricate the passivation opening 84, the second $SiO_2$ layer 74 and the $Si_xN_y$ layer 76 are etched on top of the metal layer 80. Therefore, the metal plate 88, which is made of gold or nickel, first shorts to the second metal connector in the metal layer 80 and then to ground via the passivation opening 84 and conduction channel 86 sequentially, and functions as an equivalent ground plate. The conduction channel 86 is formed in the same process as the metal plate 88, and is therefore also made but of gold or nickel.

Figure 1:
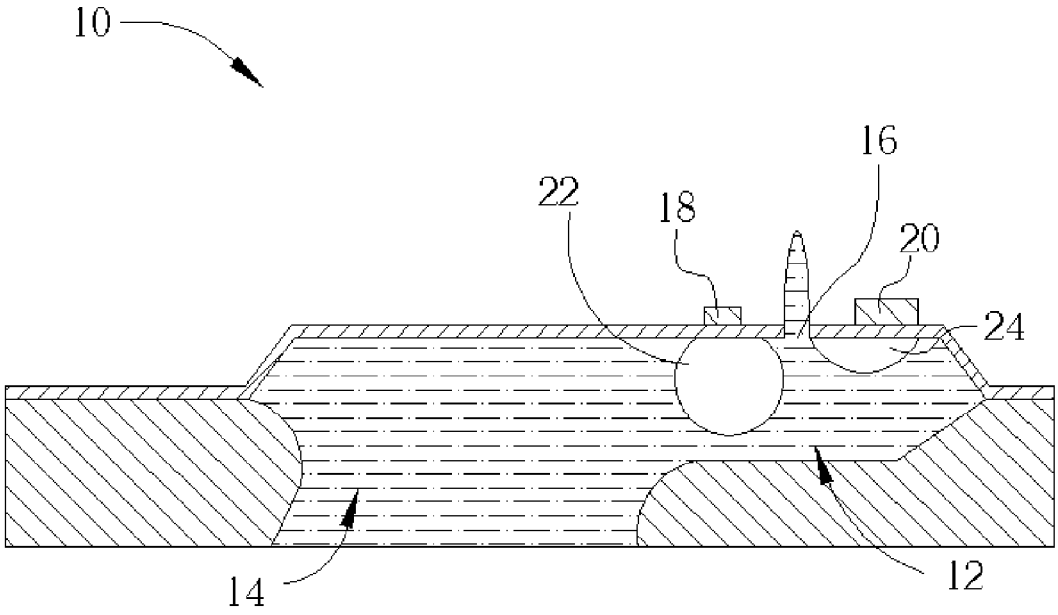
Fig. 1 Prior art
FIG. 1 is a schematic diagram of a microinjector according to the prior art.
Figure 2:
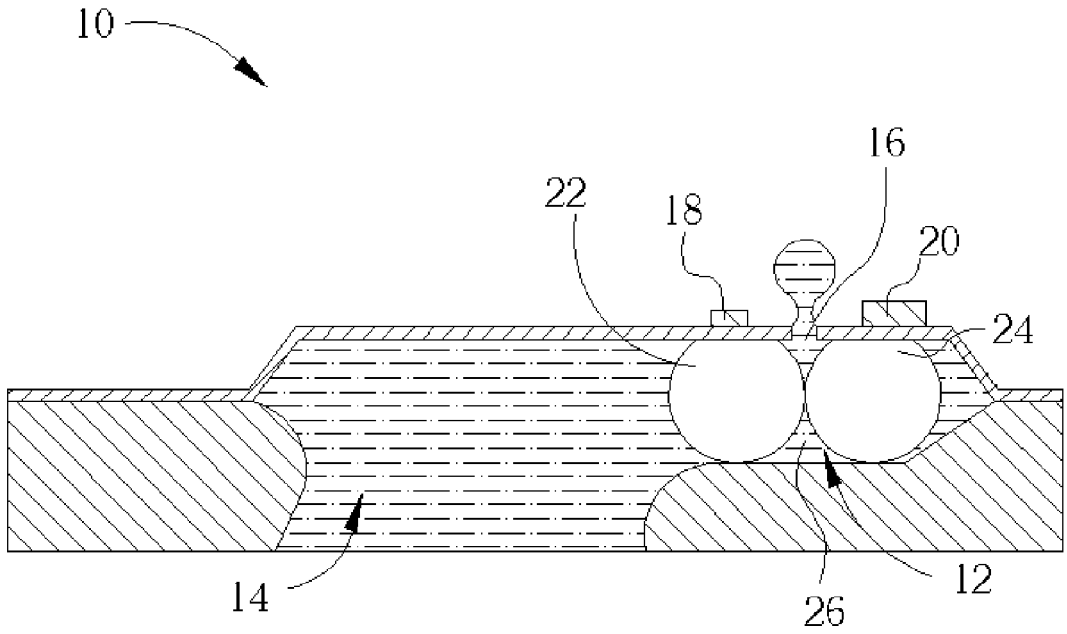
Fig. 2 Prior art
FIG. 2 is another schematic diagram of the microinjector shown in FIG. 1 according to the prior art.
Figure 3:
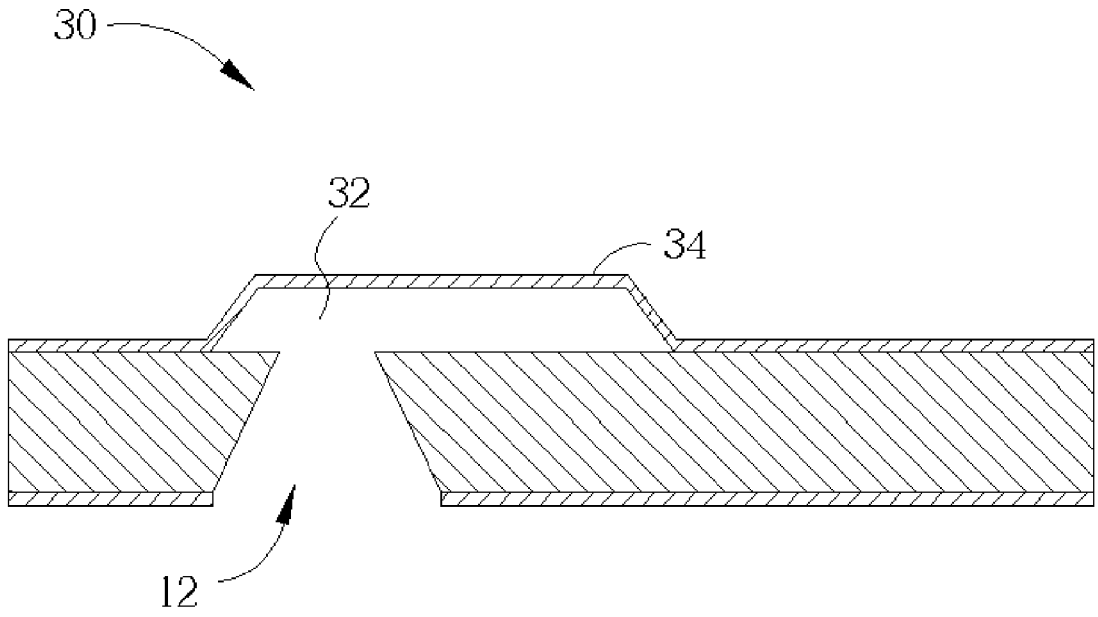
Fig. 3 Prior art
FIG. 3 is a schematic diagram of a silicon wafer ready to be etched into the microinjector shown in FIG. 1 according to the prior art.
Figure 4:
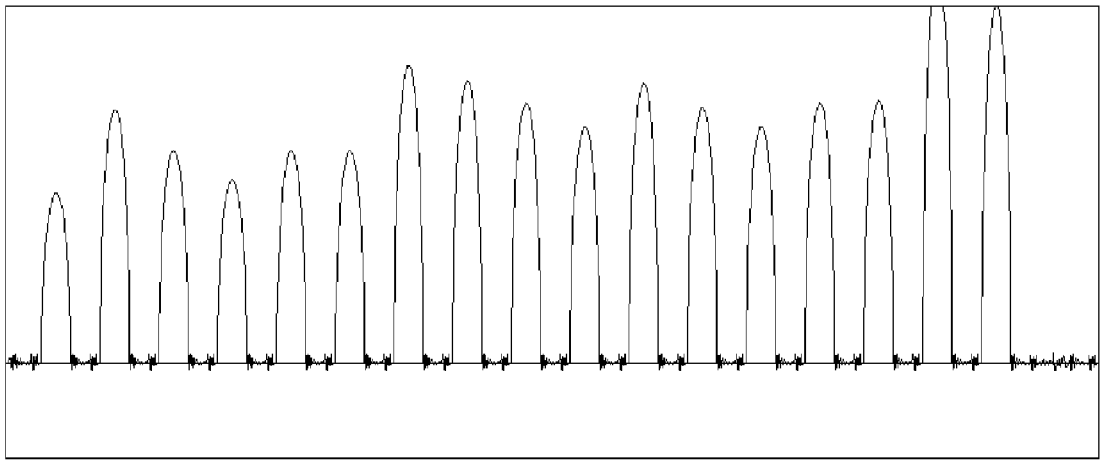
Fig. 4 Prior art
FIG. 4 is a diagram of a shark-fin-shaped overshoot waveform of a square wave according to the prior art.

Operations of the microinjector 50 are described as follows: When the microinjector 50 is selected to eject fluid and the MOSFET 70 is then turned on, a current provided by an external source travels from the metal pad 78, to the first and second heaters 62 and 64 sequentially via the first metal connector in the metal layer 80, through the source 92 and drain 90 of the turned-on MOSFET 70, and eventually to ground to enable the first and second heaters 62 and 64 to generate heat. Accordingly, the fluid contained in the chamber 54 is heated up and the first and second bubbles 22 and 24 (referring to FIG. 2) are generated sequentially to eject the fluid to a region outside of the chamber 54 through the orifice 60.

Figure 7:
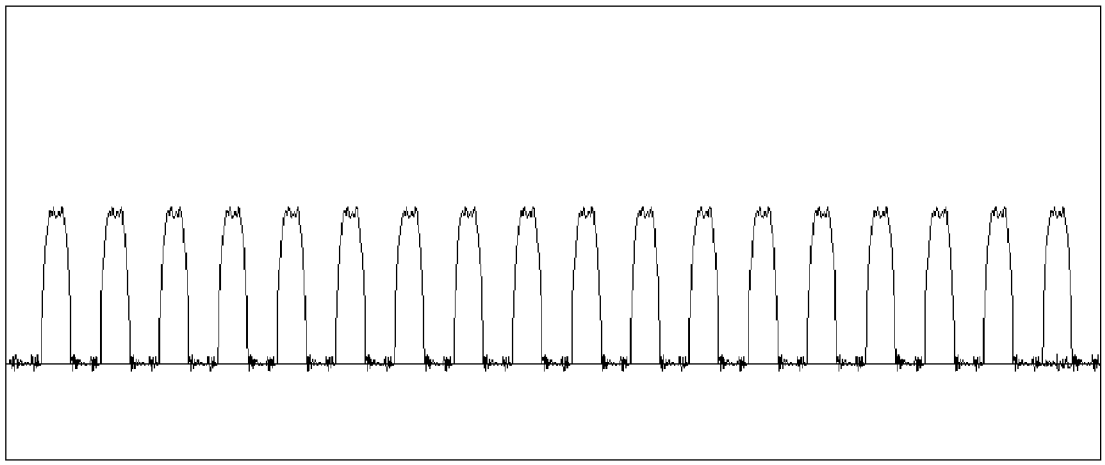
FIG. 7 is a diagram of a waveform of a square wave according to the present invention.

Please refer to FIG. 7, which is a diagram of a waveform of a square wave according to the present invention. It is apparent that the square wave has a perfect waveform.

In contrast to the prior art, the present invention can provide a microinjector 50 comprising a metal plate 88 as an equivalent ground plate, a passivation opening 84 and a conduction channel 86, the passivation opening 84 and conduction channel 86 both for transferring the parasitic capacitance collected on the metal plate 88 to ground. The microinjector 50 has at least the following advantages:

(1) Since the first and second heaters 62 and 64, covering the first $SiO_2$ layer 72, both have very poor heat conduction constants of 1.4 W/mK, and the metal plate 88, however, has a good heat conduction constant of 318 W/mK, the metal plate 88 can combine with the silicon substrate 52, also having a good heat conduction constant of 160 W/mK, to radiate heat generated by the first and second heaters 62 and 64 through a plurality of radiation polls formed by a combination of the passivation opening 84 and the conduction channel 86;

(2) The metal plate 88 strengthens the structure of the low stress silicon nitride 58; and (3) Shorting the metal plate 88 to ground via the second metal connector in the metal layer 80 not only reduces the parasitic capacitance of the metal plate 88 so that the square wave used to drive the first and second heaters 62 and 64 can have a perfect waveform, it also makes the metal plate 88 a large equivalent ground plate, with a combination of the metal plate 88 and the silicon substrate 52 as another ground plate capable of isolating circuits in the microinjector 50 from noise (shielding effect). In conclusion, the microinjector 50 provides good printing quality, high printing speed, and a long lifetime.

The microinjectior 50 not only can be applied to an ink jet printhead of a black-and-white or color ink jet printer, it also can be applied to a variety of industrial fields, such as a fuel injection system, a cell sorting system, a drug delivery system, a micro jet propulsion system, and print lithography.

Following the detailed description of the present invention above, those skilled in the art will readily observe that numerous modifications and alterations of the device may be made while retaining the teachings of the invention. Accordingly, the above disclosure should be construed as limited only by the metes and bounds of the appended claims.

What is claimed is:

1. A microinjector comprising:

a chamber for containing fluid;

an orifice in fluid communication with the chamber, the orifice disposed above the chamber;

an actuator disposed proximately adjacent the orifice and external to the chamber for ejecting fluid from the chamber;

a metal plate disposed above the chamber; and a conduction channel for connecting the metal plate to ground.

2. The microinjector of claim 1, wherein the actuator comprises a first actuating component and a second actuating component for sequentially generating a first bubble and a second bubble respectively.

3. The microinjector of claim 2, wherein the first actuating component has a cross sectional area smaller than that of the second actuating component.

4. The microinjector of claim 1 further comprising a manifold between a fluid tank and the chamber for passing fluid from the fluid tank to the chamber.

5. The microinjector of claim 1 further comprising a driving circuit electrically connected to the actuator for controlling the actuator, an end of the driving circuit connected to the actuator via a metal connector.

6. The microinjector of claim 5, wherein the metal connector is made of a metal selected from a group consisting of aluminum, gold, copper, tungsten, and alloys of Al—Si—Cu.

7. The microinjector of claim 5, wherein the driving circuit comprises MOSFETs, bipolar transistors, JFET transistors, or diodes.

8. The microinjector of claim 1 further comprising a metal oxide semiconductor field effect transistor (MOSFET) electrically connected to the actuator via a metal connector.

9. The microinjector of claim 1, wherein the conduction channel is made of a metal selected from a group consisting of gold and nickel.

10. The microinjector of claim 1, wherein the metal plate is made of a metal selected from a group consisting of gold and nickel.

11. The microinjector of claim 1 wherein the conduction channel extends through a passivation opening for connecting the metal plate to ground.

12. The microinjector of claim 1 further comprising a metal layer disposed between the chamber and the metal plate.

13. The microinjector of claim 12 wherein the metal layer and the metal plate are both connected to ground.

14. A method for reducing parasitic capacitance formed in a microinjector structure, comprising the steps of:

providing the microinjector, comprising:

a chamber for containing fluid;

an orifice in fluid communication with the chamber, the orifice disposed above the chamber, an actuator disposed proximately adjacent the orifice and external to the chamber for ejecting fluid from the chamber; and a metal plate disposed above the chamber; and forming a conduction channel for connecting the metal plate to ground.

15. The method of claim 14 wherein the conduction channel extends through a passivation opening for connecting the metal plate to ground.

16. The method of claim 14 further comprising forming a metal layer between the chamber and the metal plate.

17. The method of claim 16 wherein the metal layer and the metal plate are both connected to ground.

18. A method of providing shielding protection for a microinjector structure, comprising the steps of:

providing the microinjector, comprising:

a chamber for containing fluid;

an orifice in fluid communication with the chamber, the orifice disposed above the chamber;

an actuator disposed proximately adjacent the orifice and external to the chamber for ejecting fluid from the chamber; and a metal plate disposed above the chamber; and forming a conduction channel for connecting the metal plate to ground.

19. The method of claim 18 wherein the conduction channel extends through a passivation opening for connecting the metal plate to ground.

20. The method of claim 18 further comprising forming a metal layer between the chamber and the metal plate.

21. The method of claim 20 wherein the metal layer and the metal plate are both connected to ground.

* * * * *